United States Patent [19]

Stepp

[11] 3,954,301

[45] May 4, 1976

[54] CHAIN LINK CONVEYOR APPARATUS FOR CUTTING HARD EARTH FORMATIONS

[75] Inventor: Clarence L. Stepp, Houston, Tex.

[73] Assignee: Boring & Tunneling Co. of America, Inc., Houston, Tex.

[22] Filed: Dec. 23, 1974

[21] Appl. No.: 535,174

[52] U.S. Cl. ..... 299/76; 299/84

[51] Int. Cl.[2] ..... E21C 25/24

[58] Field of Search ..... 299/75, 82, 76, 83, 299/84, 36–38; 37/83–90; 175/89, 90

[56] References Cited

UNITED STATES PATENTS

| | | | |
|---|---|---|---|
| 2,324,033 | 7/1943 | Simmons | 299/84 |
| 2,561,657 | 7/1951 | Fulke | 299/84 |
| 2,749,105 | 6/1956 | Sibley | 299/76 |
| 3,604,755 | 9/1971 | Krekeler | 299/84 |
| 3,856,358 | 12/1974 | Krekeler | 299/82 |

FOREIGN PATENTS OR APPLICATIONS

| | | | |
|---|---|---|---|
| 941,146 | 11/1963 | United Kingdom | 299/82 |

*Primary Examiner*—Ernest R. Purser
*Attorney, Agent, or Firm*—Arnold, White & Durkee

[57] ABSTRACT

A mechanism for cutting hard earth formations such as rock comprises a prime mover vehicle such as a crawler tractor having a back plate fixed thereto. An elongated cutter bar framework is secured to the back plate in pivotal manner by means of a tool bar structure that is pivoted directly to the back plate. A motor mechanism such as a linear fluid motor is interconnected between the tool bar and the vehicle structure and is controllably operative for establishing particular angular relationships of the cutter bar framework relative to the formation to be cut and having the effect of controlling the depth of the cut being made. An endless chain conveyor assembly is disposed about idler and drive sprockets disposed at the extremities of the cutter bar framework, the conveyor comprising a plurality of pivotally interconnected chain links, each of which links supports one or more earth cutting tools which function in cooperative relationship to cut the earth formation as the chain link conveyor is rotated by the motor powered drive sprocket. To prevent excessive wear of the chain link conveyor assembly by lateral thrust loads that may be applied thereto during earth cutting operations, means is provided on the cutter bar framework defining a plurality of elongated guide and lateral thrust load support surfaces and each of the links of the chain link conveyor is provided with opposed thrust force transmitting flanges that are ordinarily disposed in juxtaposed relation with the guide surface and which engage the guide and lateral thrust load support surfaces as thrust loading is applied and limit lateral movement of the links.

5 Claims, 5 Drawing Figures

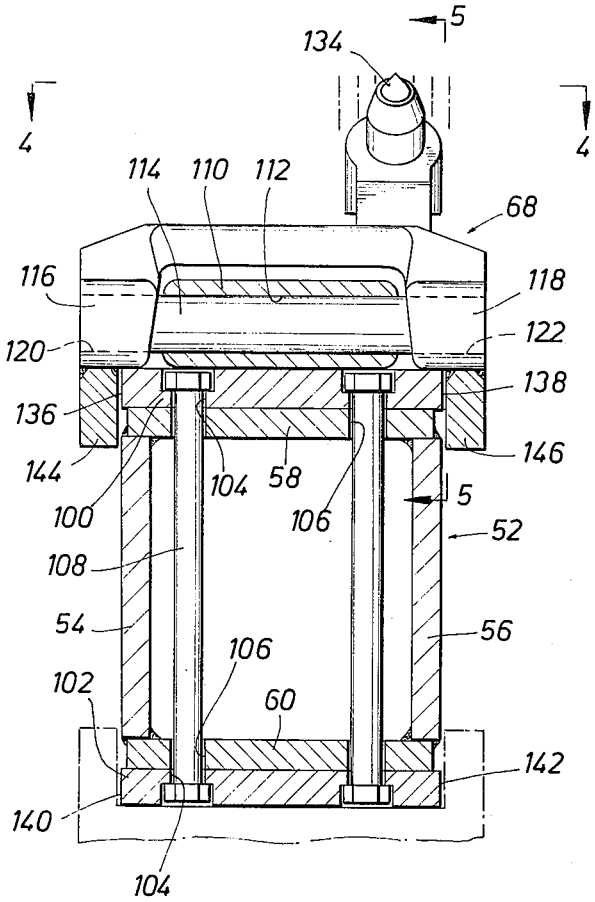
FIG. 3
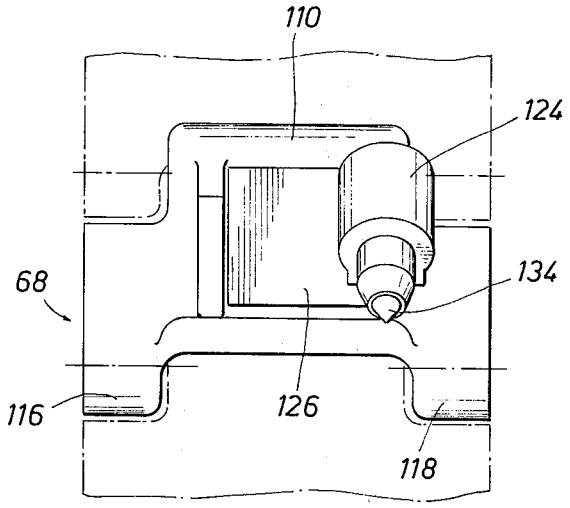
FIG. 4
FIG. 5
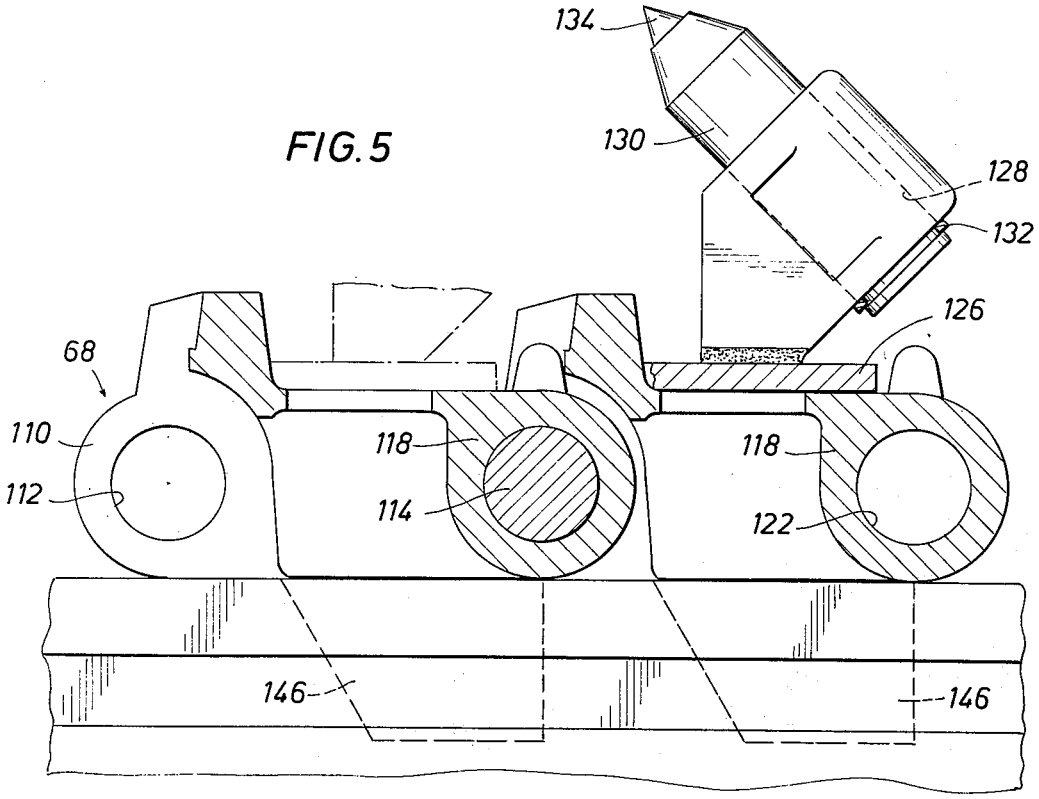

CHAIN LINK CONVEYOR APPARATUS FOR CUTTING HARD EARTH FORMATIONS

FIELD OF THE INVENTION

This invention relates generally to mechanisms for achieving cuts in earth formations such as cuts achieved for ditching operations in conjunction with pipeline installation, especially when such earth formations take the form of rock, ice, permafrost, etc. More particularly, the present invention is directed specifically to chain link type conveyor mechanisms wherein the links of the conveyor mechanism support cutting tools for achieving earth cutting operations and wherein such conveyor mechanisms may receive severe lateral thrust loading during such cutting operations.

BACKGROUND OF THE INVENTION

Mechanisms for achieving cuts in earth formations are quite well known and equally well known are mechanisms for achieving cuts in hard earth formations such as those typically involved when subterranean mining operations are being conducted, such as coal mining, where sedimentary rock is removed for exposure of veins of coal or other minerals. Where surface ditching operations are conducted and ditches are cut in the earth's surface such as when pipeline installation is being conducted, it has been determined that chain link conveyor mechanisms carrying earth cutting elements are subjected to a great deal of wear due to application of lateral thrust loads to the conveyor, especially during movement of the tractor vehicle or other prime mover during ditching operations. It is typical for prime mover apparatus to be slowly but continuously moved during ditching operations developing an earth cut, the depth of which is controlled by angulation of the ditching mechanism relative to the prime mover.

Accordingly it is a primary object of the present invention to provide a novel chain link conveyor mechanism for attachment to a prime mover vehicle, wherein the conveyor mechanism is provided with means for effectively restraining application of transverse loads to the chain link conveyor assembly.

It is a further object of the present invention to provide a novel chain link conveyor mechanism for achieving ditching operations, wherein the depth of the ditching operation is effectively controlled by controlling the angular relationship between the conveyor mechanism and the prime mover.

It is an even further object of the present invention to provide a novel chain link conveyor type ditching mechanism having wear plate means that limit wear of the conveyor mechanism and which wear plate means define opposed guide and lateral thrust load support surfaces that are cooperatively engaged by thrust load restraining flanges defined on each of the links of the conveyor mechanism and which restrain thrust loads applied individually to each link during ditching operations.

Other and further objects, advantages and features of the present invention will become apparent to one skilled in the art upon consideration of the written specification the appended claims and the annexed drawings. The form of the invention, which will now be described in detail, illustrates the general principles of the invention, but it is to be understood that this detailed description is not to be taken as limiting the scope of the present invention.

SUMMARY OF THE INVENTION

A prime mover such as a crawler tractor or the like may be provided with a back plate to which may be pivotally connected a tool bar that supports an elongated cutter bar framework having a motor driven drive sprocket at one extremity thereof while supporting an idler sprocket at the other. The tool bar and its supported cutter bar framework may be controllably positioned relative to the prime mover vehicle by means of a motor, such as a linear fluid motor, that is interconnected between the prime mover and the tool bar and which is operative to control the pivotal relationship of the tool bar relative to the back plate. A chain link conveyor, incorporating a plurality of interconnected links, is operatively assembled about the drive and idler sprockets and is rotated upon energization of the sprocket drive motor. One or more cutter tool elements are carried by each of the links of the chain link conveyor assembly, each cutter being disposed in a particular angular relationship with its respective link so as to achieve a cutting operation as the tool is moved into the earth formation during rotary movement of the conveyor.

Opposed wear plates may be supported by the cutter bar framework which wear plates prevent unnecessary wear of the chain link conveyor assembly and the cutter bar assembly as the conveyor rotates during ditching operations. The wear plates may also be configured to define opposed link guide and thrust load absorbing surfaces. Thrust load restraining flanges are carried in opposed spaced relationship by each of the links of the chain link conveyor assembly, which flanges are disposed in close proximity to respective ones of the guide and thrust load absorbing surfaces. Upon application of thrust loads to the individual links of the chain link conveyor assembly, regardless of the particular lateral direction of thrust load application, respective ones of the thrust load restraining flanges will engage respective guide surfaces transmit the thrust load applied to the links directly to the cutter structure through the guide surface of the wear plate. This feature prevents excessive lateral movement of the individual links and also retards development of unnecessary stress at the connections between the individual links and thereby prevents unnecessary wear at the link connections.

BRIEF DESCRIPTION OF THE DRAWINGS

So that the manner in which the above recited features, advantages and objects of the present invention, as well as others, which will become apparent, are attained and can be understood in detail, more particular description of the invention, briefly summarized above, may be had by reference to the embodiment thereof which is illustrated in the appended drawings, which drawings form a part of this specification.

It is to be noted, however, that the appended drawings illustrate only a typical embodiment of the invention and are therefore not to be considered limiting of its scope, for the invention may admit to other equally effective embodiments.

In the Drawings:

FIG. 1 is a side elevational view depicting a portion of a prime mover such as a crawler tractor and having an earth formation ditching mechanism connected thereto, the ditching mechanism being raised above the normal level for conducting ditching operations.

FIG. 2 is a top view of the ditching mechanism taken along line 2—2 of FIG. 1 with the chain link conveyor thereof removed so as to illustrate the details of the cutter bar framework and its manipulating support apparatus in detail.

FIG. 3 is a transverse sectional view taken along line 3—3 in FIG. 1, showing the details of the cutter bar assembly and illustrating the relationship of the chain link conveyor mechanism thereto.

FIG. 4 is a fragmentary plan view taken along line 4—4 of FIG. 3 illustrating in full line a single link of the chain link conveyor assembly of FIGS. 1 and 3 and showing in broken line the relationship of adjacent links to the link shown in full line.

FIG. 5 is a fragmentary side elevational view of a portion of the cutter bar framework and the chain line conveyor mechanism supported thereby and illustrating positioning of one of the cutter elements supported by a link of the chain link conveyor assembly.

DESCRIPTION OF PREFERRED EMBODIMENT

Figures 1, 2:
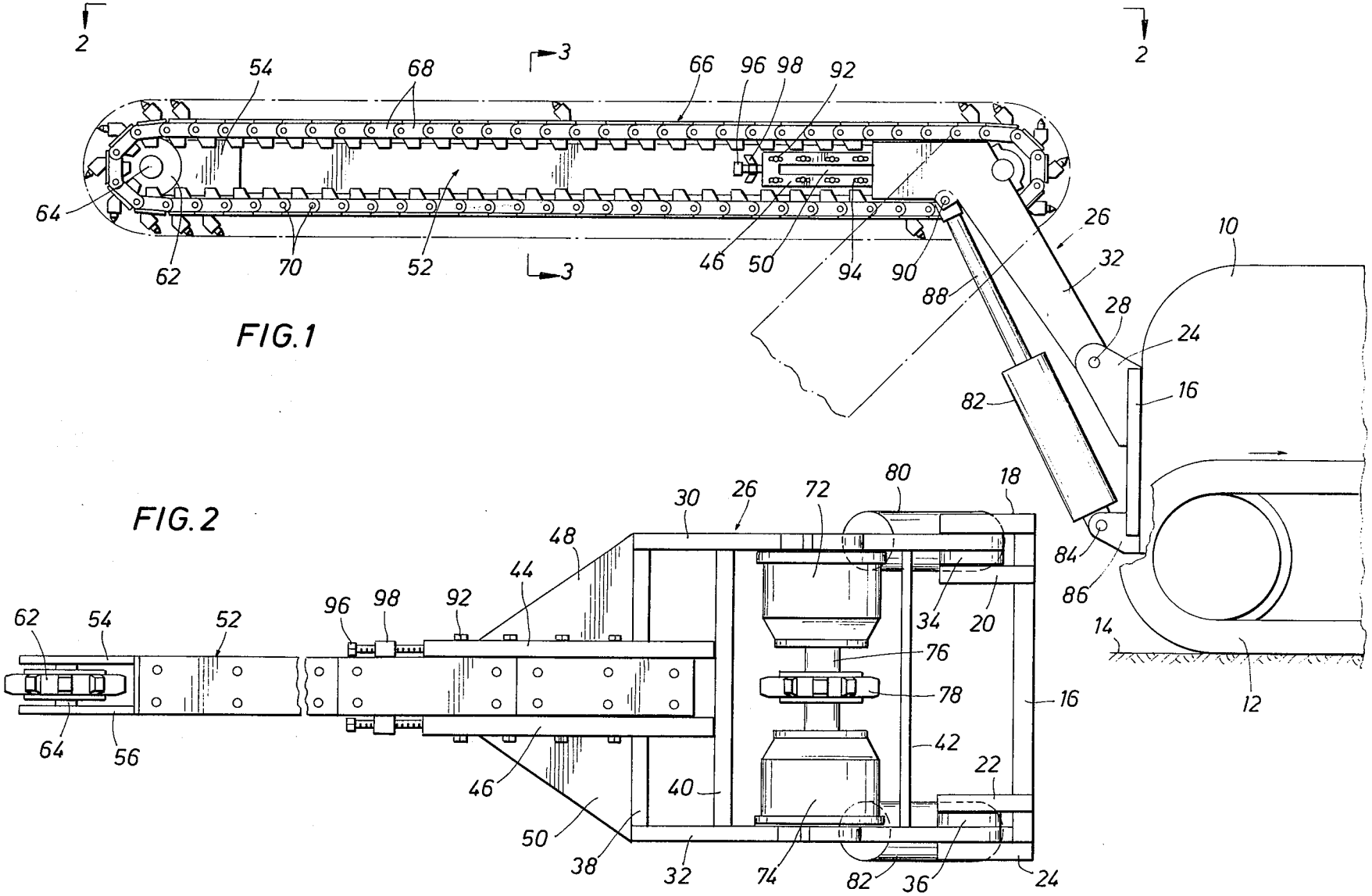

Referring now to the drawings and particularly to FIG. 1, a ditching mechanism for achieving ditching operations in relatively hard earth formations such as rock may take the form illustrated wherein a prime mover mechanism 10 is employed that may be a crawler tractor having track assemblies 12 that propel the prime mover over the earth surface 14. For conducting ditching operations in the earth formation 14 it is desirable that the prime mover move in the direction shown by the arrow in order that the ditching mechanism may be pulled along as ditching operations are conducted. The prime mover may be provided with a back plate 16 having a plurality of pivot flanges 18, 20, 22 and 24 fixed thereto which flanges pivotally receive a tool support arm assembly, illustrated generally at 26, that is secured to the flanges by means of pivot 28 pins extending through aligned pivot apertures formed in the flanges. As shown in detail in FIG. 2, the tool support arm assembly may include a pair of generally parallel related arms 30 and 32 having spacer plates 34 and 36 fixed to pivot extremities thereof with aligned pivot apertures being formed through pivot extremities of the arms 30 and 32 and through spacer plates 34 and 36 that may be aligned with respective apertures of the pivot support flanges. Transverse structural braces 38, 40 and 42 may be connected in any suitable manner, such as by welding, bolting or the like between the arms 30 and 32.

For the purpose of supporting elongated apparatus for accomplishing ditching operations as the prime mover is moved along a right of way, the tool support arm assembly may be provided with cutter bar support structure which may conveniently take the form of a pair of generally parallel structural elements 44 and 46 that may be connected to the transverse structural elements 38 and 40 such as by welding, bolting or the like. The connection of the structural elements 44 and 46 to the tool support arm assembly may be reinforced by means of gussets 48 and 50 that may be secured to the structural elements 44 and 46 and to structural element 38 by means of welding or the like.

It will be desirable for achieving cutting operations in earth formations that an elongated conveyor support be provided which will serve as a guide for a rotatable cutter tool supporting mechanism. In accordance with the present invention a tool carrier support mechanism may conveniently take the form of an elongated cutter bar framework illustrated generally at 52 that is supported between the structural elements 44 and 46. Referring particularly to FIG. 3, the cutter bar framework 52 may comprise a pair of generally parallel related side plates 54 and 56 to which may be welded or otherwise secured a top plate 58 and a bottom plate 60 causing the elongated cutter bar to be in the form of a generally rectangular tubular structure. The top and bottom plates 58 and 60 terminate short of the trailing extremity of the side plates 54 and 56, causing the side plates to define a bifurcation within which may be disposed an idler sprocket 62. A shaft 64 supporting the idler sprocket 62 may be supported by bearings carried by the opposed side plates 54 and 56. In the alternative, the shaft 64 may simply be retained by appropriate apertures formed in the side plates and the idler sprocket 62 may have a rotatable bearing relationship with the shaft 64 in order to allow free rotation of the sprocket.

As illustrated in FIG. 1 and also in FIGS. 3, 4 and 5, a chain link conveyor assembly illustrated generally at 66 may be disposed about the cutter bar assembly with upper and lower reaches of the chain link conveyor defined at least partially by the top and bottom plates of the cutter bar structure. The chain link conveyor assembly will be defined by a plurality of chain links 68 which are interconnected by a plurality of pivot pins 70. The links of the conveyor assembly are received by the teeth of the idler sprocket 62 allowing the conveyor assembly to revolve about the idler sprocket as it traverses between each of the reaches thereof during rotational movement.

It will be desirable to impart powered rotational movement to the chain link conveyor assembly 66 for accomplishing ditching operations and, according to the present invention, such means may conveniently take the form of one or more drive motors such as shown at 72 and 74 that are connected to the tool support arm structure and which have driving relation with a drive sprocket shaft 76 to which a drive sprocket 78 is nonrotatably secured. The drive motors 72 and 74 impart rotation to the shaft 76 and sprocket 78, thereby causing driving rotation of the chain link conveyor assembly 66 which is also received by the drive teeth of the sprocket 78. The drive motors 72 and 74 may take any suitable form as desired, such as hydraulic or electric motors or as simply a gear mechanism that is powered by a conventional power take-off assembly of the prime mover. In the preferred form of the invention, however, the drive motor 72 and 74 are hydraulically energized motors that are energized by a conventional hydraulic fluid supply system, not shown, carried by the prime mover. The operating personnel of the prime mover will have manipulative controls for the purpose of controlling energization of the drive motors for rotation of the conveyor mechanism.

It will be desirable to provide means for controlling angular positioning of the conveyor mechanism 66 relative to the earth formation for accomplishing ditching operations. According to the present invention, means for imparting controlling pivotal movement to the tool support arm assembly 26 may conveniently take the form illustrated in FIGS. 1 and 2 where a pair of linear fluid motors 80 and 82 are interconnected between the prime mover and the tool support arm assembly and, when energized, cause pivoting of the tool support arm assembly about the pivot established by pivot pins 28. The lower portion of each of the cylinders 80 and 82 may be pivotally secured to the prime mover by means of pivot pins 84 which are received within apertures formed in motor support flanges 86 that may be secured directly to the prime mover or, in the alternative, may be connected in any suitable manner to the back plate 16. The operating rod or shaft 88 of each of the fluid motors 80 and 82 may be connected by means of a pivot pin 90 to the tool support arm assembly 26, thereby allowing the operating shaft 88, which is controlled by pistons disposed within each of the cylinder motors 82, to impart pivotal movement to the arm assembly 26 upon being moved linearly. Usual control valves and power supply systems, not shown, will be employed for selectively energizing the fluid motors 80 and 82 under control of the operating personnel.

It will be desirable to provide means for adjusting the position of the cutter bar assembly 52 relative to the structural elements 44 and 46 in order that the chain link conveyor assembly may be adjustably tightened to an optimum degree after installation thereof. In accordance with the present invention, the cutter bar 52 may be provided with a plurality of apertures through which bolts 92 extend, the bolts being received through elongated apertures 94 formed in the respective structural elements 44 and 46. An adjustment bolt 96, or other suitable adjustment mechanism, may be simply manipulated for movement of the cutter bar 52 relative to the structural support elements 44 and 46 within limits defined by the elongated adjustment apertures 94. An adjustment structure 98 may be secured to the cutter arm 52 and may have a threaded aperture formed therein which receives the adjustment bolt 96.

It will be desirable to provide the cutter bar assembly 52 with means for preventing wear of the upper and lower plates 58 and 60 thereof and for preventing excessive wear of the chain link conveyor assembly as it rotates during ditching operations. In accordance with the present invention, upper and lower wear plates 100 and 102 may be provided having apertures 104 formed therein which may be aligned with apertures 106 formed in the upper and lower plates 58 and 60. Wear pad retention bolts 108 may be received within the aligned apertures of the wear pads and the upper and lower plates of the cutter bar assembly for retention of the wear plates in place. The head portions of the bolts may be retained within recesses formed in the respective wear plates, thereby preventing contact between the links of the conveyor assembly and the heads of the bolts. The wear plates 100 and 102 may be formed of any suitable wear resistant material, depending upon the material from which the chain link conveyor mechanism is formed.

With regard now to FIGS. 3, 4 and 5, each of the links generally shown at 68 will be provided with a central connector portion 110 having a bore 112 formed therein, which bore is adapted to receive a link connector pin 114 therein. Each of the links is also provided with a pair of spaced connector portions 116 and 118 having connector bores 120 and 122 formed respectively therein and receiving the extremities of the connector pin 114. The connector pins 114 therefore establish connection with adjacent links causing the connected links to define a conveyor assembly.

A plurality of bit block retainer devices 124 may be provided each having a base portion 126 thereof assembled to respective ones of the links of the conveyor mechanism. If desired the base portions 126 may be welded to the individual links or in the alternative may be connected to the links in any other suitable manner. The bit block retainer devices may in turn be welded to the respective base portions 126, thereby achieving variation of positioning as is necessary for proper location of the bits. The bit block retainer devices may be provided with a bore, such as shown in broken line at 128, which is provided for receiving a bit block 130 that may be secured to the bit block retainer device by means of a snap ring 132 or any other suitable means of retention. A pointed pick type bit 134 composed of a very hard wear resistant material, such as tungsten carbide for example, may be retained within the bit block 130 in any suitable manner. The pick type bit will provide the cutting function as the chain link conveyor mechanism is moved into the earth formation during ditching operations. As shown in FIG. 3, by way of broken lines at the upper portion of the figure, the various bit retainer devices will be disposed in staggered orientation, thereby allowing the pick type bits to track differing cutting paths in order to achieve a cut in the earth formation that is greater than the width of the chain link conveyor assembly.

As explained above, during ditching operations it is typical for individual ones of the links of the chain link mechanism to be subjected to lateral forces, which lateral forces can be quite severe. When this occurs, the links will be moved transversely, which causes pivotal loading to be applied to adjacent links in order to restrain such lateral movement. When this occurs the connecting pins 114 are subjected to severe shear forces and the pivotal relationship between the connecting pins and the apertures within which the pins are received thereby creating a condition of excessive wear which is capable of deteriorating the chain link conveyor mechanism within a short period of time. In order to overcome the problems created by transverse thrust loading, the upper and lower wear plates 100 and 102 are formed to define substantially flat elongated guide and thrust load absorbing surfaces 136, 138, 140 and 142. Additionally, each of the links 68 of the chain link conveyor mechanism may be provided with thrust load transmitting flanges 144 and 146 which flanges are disposed in opposed spaced relation and, when the links are assembled to the cutter bar assembly, the flanges 144 and 146 will be disposed in juxtaposed relation with the opposed guiding and thrust force absorbing surfaces 136 and 138.

As transverse loads are applied to the individual links of the chain link conveyor assembly during ditching operations, such as when the prime mover moves in such a manner to cause a slight deviation in the direction of the ditch being formed, thrust loads applied to the links 68 will be transmitted through the respective one of the flanges 144 and 146 to the respective guide surface of the wear plates. The thrust force will therefore be transmitted directly into the cutter bar structural framework and there will not be developed an angular connection stressing relationship between the links of the conveyor mechanism that will subject the connector pins to shear forces and cause excessive wear at the movable points of connection between the links and the connector pins. Through utilization of the cooperative transverse thrust load transmitting relationship between each of the links and the cutter bar framework, the useful life of the chain link conveyor mechanism will be substantially extended and therefore the commercial feasibility of ditching operations in hard earth formations will be materially enhanced.

In view of the foregoing, it is apparent that the present invention is one well adapted to attain all of the objects hereinabove set forth together with other advantages which will become obvious and inherent from the description of the apparatus itself. It will be understood that certain combinations and subcombinations are of utility and may be employed without reference to other features and subcombinations. As many possible embodiments may be made of the invention without departing from the spirit or scope thereof, it is to be understood that all matters herein set forth or shown in the accompanying drawings are to be interpreted as illustrative and not in a limiting sense.

What is claimed is:

1. Apparatus for conducting cutting operations in hard earth formations, said apparatus comprising:

a conveyor support member being movably connected to a prime mover mechanism, said conveyor support member including a hollow cutter bar framework having top, bottom and side pieces disposed in fixed relation one to the other, said top and bottom pieces having a plurality of apertures, wear plates being assembled to said top and bottom pieces and having transverse edges formed thereon defining opposed guide and lateral force restraining surfaces;

bolt means extending through said apertures of said top and bottom pieces and securing said wear plates in assembly with said cutter bar framework;

rotary conveyor sprocket means disposed at each extremity of said cutter bar framework;

a chain link conveyor assembly being received by said conveyor support member, said chain link conveyor assembly including a plurality of interconnected links adapted for mating engaging relation with said conveyor sprocket means;

earth cutting means supported by each of said links and disposed for cutting engagement with the earth formation;

means for imparting rotary movement to said sprocket means to cause rotary movement of said interconnected links; and a pair of spaced lateral thrust load transmitting flanges extending from each of said links and being disposed for guiding contacting relation with said opposed guide and lateral force restraining surfaces, said flanges engaging said guide and lateral force restraining surfaces responsive to application of lateral thrust forces thereto, transmitting said lateral thrust loads directly into said conveyor support member and preventing lateral overstressing of the connections between the links of said chain link conveyor assembly by said lateral thrust forces.

2. Apparatus as recited in claim 1, wherein:

said wear plates have a plurality of apertures aligned with the apertures of said cutter bar framework, said wear plate apertures adapted for receiving said bolt means.

3. Apparatus as recited in claim 1 wherein said wear plates have a plurality of recesses adapted for retaining each extremity of said bolt means and preventing contact between said links and said bolt means.

4. Apparatus as recited in claim 1 wherein said lateral thrust load transmitting flanges are formed integrally with said links of said conveyor assembly.

5. Apparatus as recited in claim 1 wherein said apparatus includes:

support means for connecting said apparatus to a movable vehicle; and linear fluid motor means interconnected between said movable vehicle and said cutter bar framework, said motor means being controllably movable for adjusting the angular relation of said cutter bar framework relative to said earth formation.

* * * * *